US005185988A

United States Patent [19]

Cunningham

[11] Patent Number: 5,185,988

[45] Date of Patent: Feb. 16, 1993

[54] TOWER COMPRESSION UNIT

[76] Inventor: Thomas J. Cunningham, 11120 Rotherick Dr., Alpharetta, Ga. 30302

[21] Appl. No.: 649,456

[22] Filed: Feb. 1, 1991

[51] Int. Cl.[5] ..... B65B 35/52

[52] U.S. Cl. ..... 53/436; 53/387.1; 53/541; 198/860.4; 414/795.3

[58] Field of Search ..... 198/860.4; 414/794.9, 414/795, 795.3; 221/281; 53/387.1, 387.2, 387.3, 526, 527, 541, 436, 491

[56] References Cited

U.S. PATENT DOCUMENTS

| | | | |
|---|---|---|---|
| 2,609,111 | 9/1952 | Daves et al. | 414/795.3 X |
| 2,904,941 | 9/1959 | Midnight | 53/387.2 X |
| 2,970,526 | 2/1961 | Gobalet | 53/387.2 X |
| 3,105,334 | 10/1963 | Marshall | 53/387.2 X |
| 3,145,518 | 8/1964 | Ricca | 53/387.2 |
| 3,236,027 | 2/1966 | Schmermund | 53/387.3 |
| 3,482,372 | 12/1969 | Hottendorf | 53/462 |
| 3,765,145 | 10/1973 | Davis | 53/387.1 X |
| 3,899,863 | 8/1975 | Seragnoli et al. | 53/387.2 X |
| 3,994,119 | 11/1976 | Ellis | 53/387.3 |
| 4,250,693 | 2/1981 | Andersson | 53/543 |
| 4,984,412 | 1/1991 | Finn | 53/387.1 |

*Primary Examiner*—John Sipos
*Assistant Examiner*—Daniel Moon
*Attorney, Agent, or Firm*—Jones, Askew & Lunsford

[57] ABSTRACT

A tower compression unit having a case compression tower with vertically oriented surfaces defining a compression chamber, and an access gate associated with the tower compression unit. The access gate has a means for moving the cases within the tower by applying a vertical force to the cases. The force is applied through machinery attached to or received through the access gate.

4 Claims, 8 Drawing Sheets

TOWER COMPRESSION UNIT

TECHNICAL FIELD

The present invention relates to a tower compression unit used in the packaging industry. More particularly, the present invention is directed to a purge unit associated with a tower compression unit. The purge unit provides accessibility to a compression tower within the tower compression unit so that cases remaining in the compression tower unit may be automatically removed.

BACKGROUND OF THE INVENTION

The packaging industry today is almost entirely automated. For manufacturers of packaged items an automated case packaging process is quicker, less expensive and safer than its manual counterpart.

A typical automated case packaging assembly includes a collator and/or feeder of items to be packaged, a case blank feed device, a case folding device, a case advance section and a compression area. The collator arranges the items to be packaged and transfers them to the folding area. At the same time, a case blank feed device pulls a flat pre-cut case blank from a stack of case blanks and transfers it to the folding device. The case blank is set in place and receives the items for packaging. The folding device folds the case blank around the items and transfers the case to the case advance section. The case advance section applies adhesive to the case and seals it. The case then enters the compression section where it is compressed either vertically or horizontally before it is stacked and prepared for shipping.

A vertically oriented compression arrangement is advantageous in that it provides compression to all surfaces of a case while horizontal case packaging provides compression only to the sides of a case. Thus a higher quality packed case results from a vertical compression process. Moreover, vertical compression requires less area within a case packaging plant, thereby decreasing the total floor space required for the case packaging operation. In addition, vertical compression is advantageous because it is compatible with most palletizer operations. Before shipping, cases are typically stacked onto pallets. This process (palletizing) is usually done by loading the cases onto the top of the palletizer, thereby requiring the cases to enter at a higher elevation. With vertical compression, the cases enter at a low level and are discharged at a higher level, so the compatibility of the vertical compression arrangement with a palletizer operation simplifies the case packaging operation.

A typical vertical compression unit includes a vertically oriented compression tower, a means for receiving the sealed case from the case advance section, a means for moving the sealed case to the bottom of the stack of cases, and a means for elevating the case from a first level to a second level.

During the case packaging operation, there may be over fifty cases stacked on top of each other within the compression tower. Before a different type or size of product enters the case packaging operation, it is preferable to clear the remaining cases within the assembly line so the products and/or batches remain separated. It is also common to clear the assembly line during shift changes. To clear the assembly line, the entire operation is shut down and the cases within the compression tower are removed. In the past, removal of the cases within the compression tower was done by manually removing each case. This procedure was time consuming and hazardous. Because manual removal is time consuming, money is lost due to the lack of productivity of the assembly line.

Manual removal of the case is also unsafe and injurious to worker's health. Most compression towers are constructed eight to twelve feet in height. Many accidents have occurred when workers try to unload the cases at the top of the stack without having proper support or having to climb on and around machinery not designed for human support. Previous tower compression units have been designed so that the cases within the stack are not readily accessible. Thus, the only way to remove the cases has been by manually picking them off of the top of the stack or pulling them from the bottom of the stack. Either method of removal requires considerable physical effort and tends to injure many workers.

Additionally, damage to machinery often occurs when workers use the machinery for support while unloading cases within the tower. Due to the lack of accessibility of previously designed compression towers, mechanical repairs or replacement of parts have been difficult to accomplish and require considerable down time, which have resulted in lost productivity and, consequently, lost profits.

Thus, there is a need in the case packaging industry for a tower compression unit that quickly purges the remaining cases within a case packaging assembly thereby minimizing down time and maximizing productivity.

There is a further need for a compression tower that automatically purges the remaining cases from a compression tower without requiring the use of manual labor.

There is yet a further need for a tower compression unit that is readily accessible for repair or replacement of parts.

SUMMARY OF INVENTION

The present invention solves the above-described problems by providing a tower compression unit having a case compression tower and a purge unit associated therewith. The case compression tower includes a frame having four surfaces that define an interior compression chamber. The compression chamber has a means for transferring a case within the chamber from one level to another. The purge unit includes a purge gate hinged to the tower compression unit. The purge unit also has a means for transferring cases along a vertical axis of the purge gate. The purge gate provides accessibility to the compression tower from the exterior so that automatic removal of cases within the compression chamber is possible.

Thus, it is an object of the present invention to provide a tower compression unit that purges the remaining cases from the unit quickly, thus minimizing down time and maximizing productivity.

It is a further object of the present invention to provide a tower compression unit that automatically purges the remaining cases within the compression tower without requiring the use of manual labor.

It is yet a further object of the present invention to provide a tower compression unit that is readily accessible.

Other objects, features and advantages of the present invention will become apparent upon reading the following detailed description of the embodiments of the invention when taken in conjunction with the drawing and appended claims.

BRIEF DESCRIPTION OF THE DRAWING

The invention will now be described with reference to the accompanying drawings which illustrate a preferred embodiment of the tower compression unit, falling within the scope of the appended claims and in which:

DETAILED DESCRIPTION OF THE PREFERRED EMBODIMENT

Figure 1:
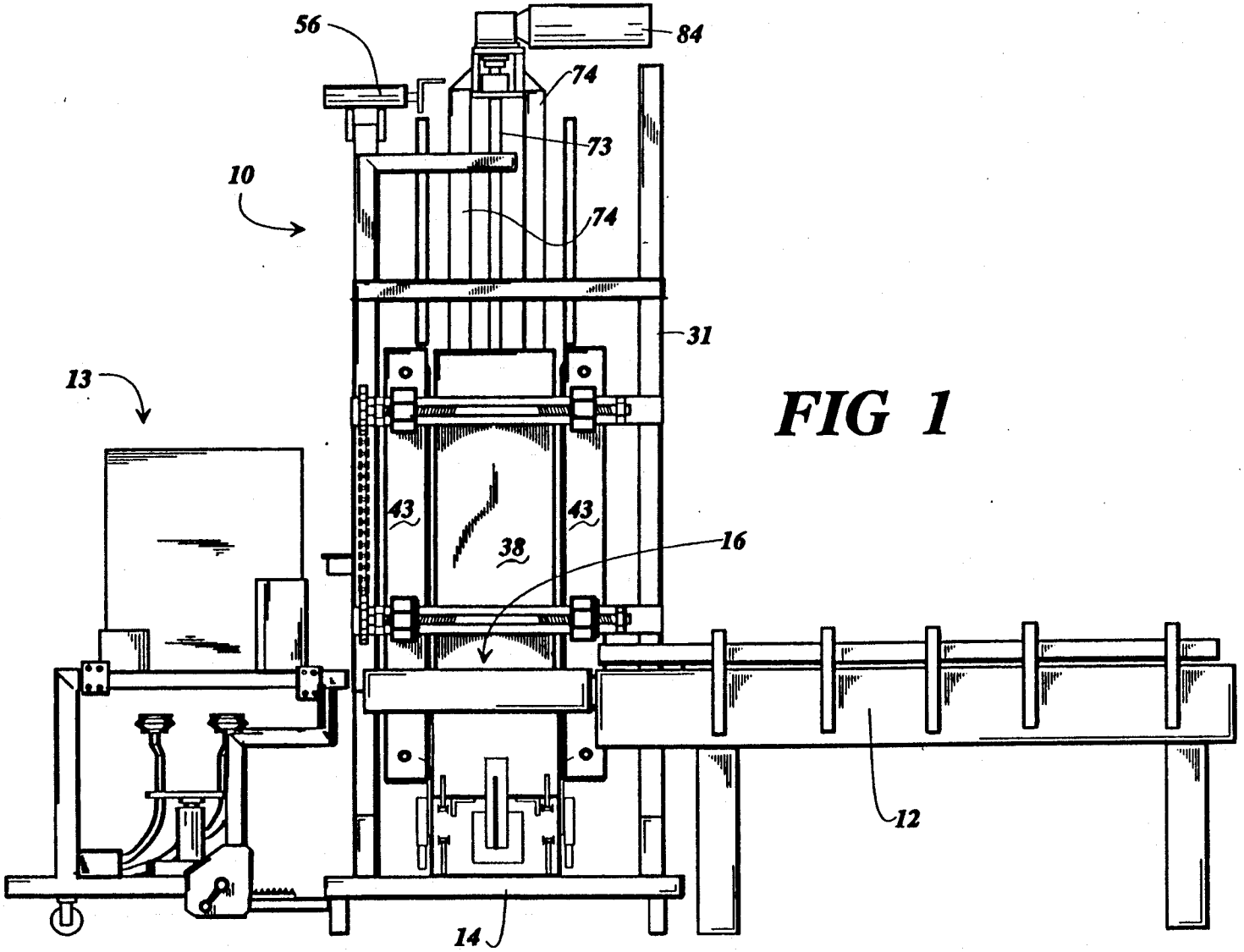
FIG. 1 is an overall perspective view of the tower compression unit as it is associated with other components that make up a packaging assembly.
Figure 2:
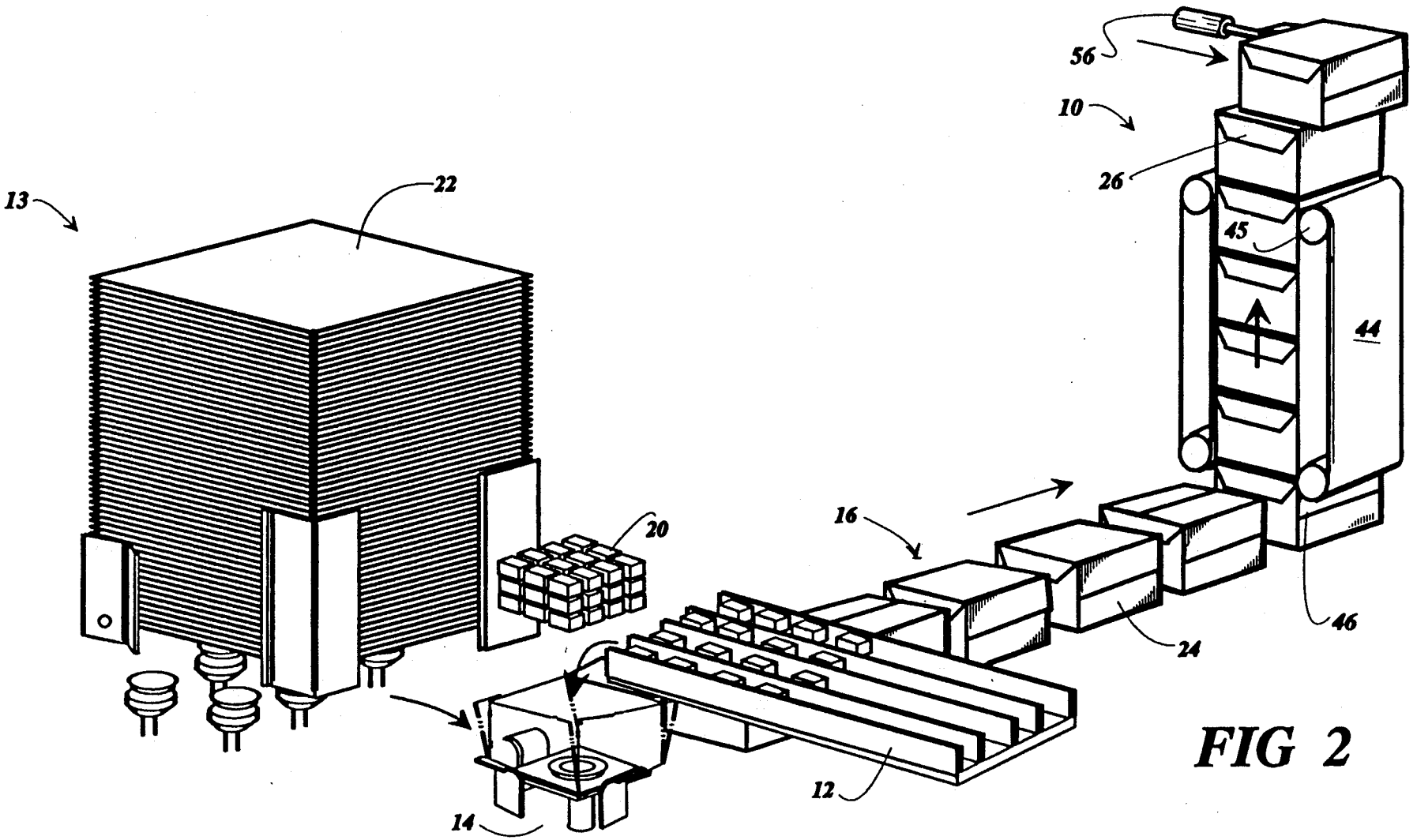
FIG. 2 is an exploded view of the preferred embodiment and other case packaging assembly components.

Referring now in more detail to the drawings in which like numerals indicate like parts throughout the several views, FIGS. 1 and 2 show the tower compression unit 10 and its relation to other machines that make up a case packaging assembly. FIG. 2 illustrates the general operation of a packaging assembly.

The other case packaging assembly machines include a collator 12, a case blank feed device 13, a folding device 14, and a case advance section 16. The case blank feed device 13 transfers a single case blank 22 to the folding device 14 where the case blank receives the packaged items 20 advanced from the collator 12. The folding device 14 partially folds the case blank 22, shown in FIG. 2, around the items 20 then moves the case to the case advance section 16 where the case is completely folded and sealed. The case advance section 16 advances the case 24 to the receiving chamber 21 of the tower compression unit 10. The tower compression unit 10 forces the case 24 into the bottom of a stack of cases 26. The weight of the stack 26 compresses the case 24. When the case 24 reaches the top of the tower compression unit 10, the case is ejected by means of a case ejector 56 and is then advanced typically by means of a conveyor (not shown) to a palletizer (not shown) where the cases are stacked and prepared for shipping.

Figure 3:
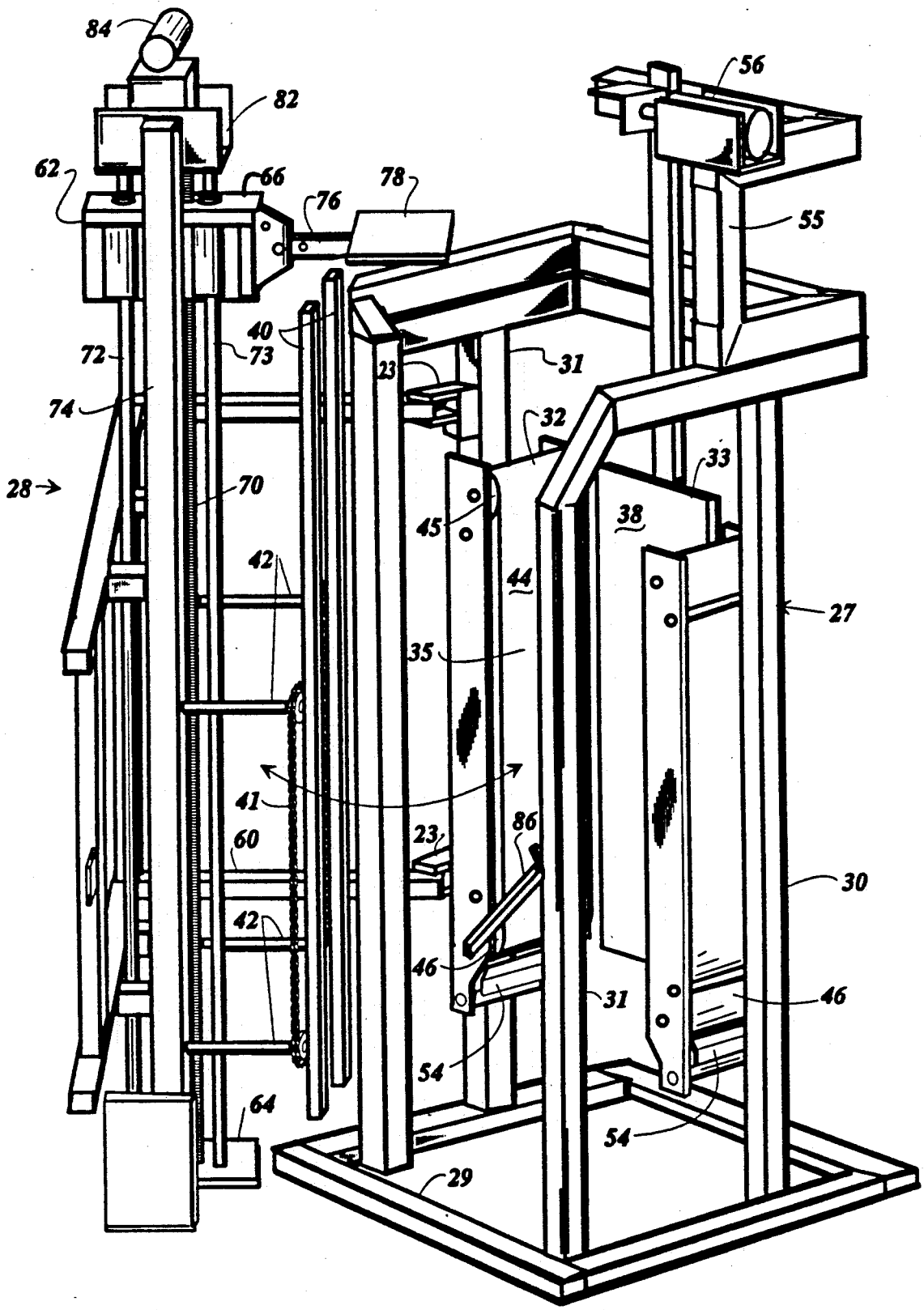
FIG. 3 is a perspective view of the preferred embodiment in an opened position.

Turning now to FIG. 3, the tower compression unit 10 of the present invention includes a compression tower 27 and a purge unit 28. The compression tower 27 has a base 29 which structurally supports a frame 30 having vertically oriented beams 31 that help to form the compression chamber 32. The beams 31 are fixed to the base 29 and are located so as to support four interior surfaces 33, 34, 35, 36 that define the compression chamber 32. The first surface 33 is defined by a plate 38 secured to the frame 30 along the edge of the chamber 32 which the cases first pass when entering the compression chamber. Opposite from and facing the fixed plate 38 or first surface 33, are a pair of parallel, spaced apart vertically oriented rails 40 (the "second" surface 34). The rails 40 are adjustably secured to the frame 30 by means of adjustment screws 42 located at two places along the length of each rail. The rails 40 are adjusted by means of a chain 41 so that both places along the rail are adjusted simultaneously.

The third 35 and fourth 36 surfaces of the compression chamber 32 are defined by adjustable one-way belts 44. Each belt 44 is supported at both ends by rollers 45, 46. The roller 45 located at the top of the belt is a one-way roller. This helps to prevent cases 24 from falling back down the chamber 32 while they are within the chamber 32. Each pair of rollers 45, 46 are mounted to a roller frame assembly 43. Each roller frame assembly 43 is mounted to the frame 30 with two threaded bars 47 having both left and right handed threads so as to enable the third 35 and fourth 36 surfaces to be adjusted simultaneously. The threaded bars 47 for each roller frame assembly 43 are connected by means of a chain 48 to allow both locations on the roller frame assembly to be adjusted simultaneously.

Figure 4:
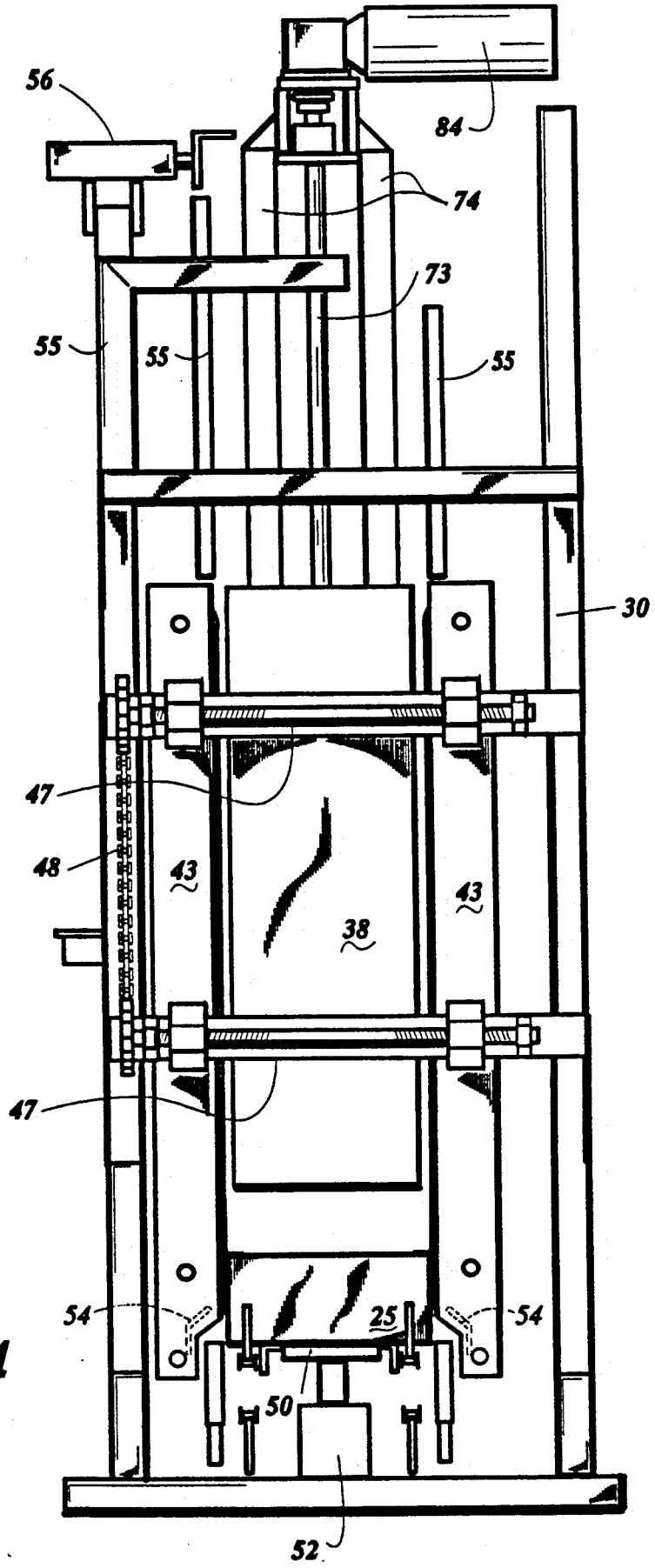
FIG. 4 is a front view of the preferred embodiment.

Located at the bottom of the compression chamber 32 is a platform 50, as shown in FIG. 4. The platform 50 is connected to an air cylinder 52. The air cylinder 52 provides reciprocal vertical motion to the platform 50. A pair of spring-loaded dogs 54 are secured to the third 35 and fourth 36 surfaces of the chamber 32. The dogs 54 hold up the bottom case 25 in the chamber 32 and prevent it from descending while another case 24 is moved into the chamber 32.

Figure 5:
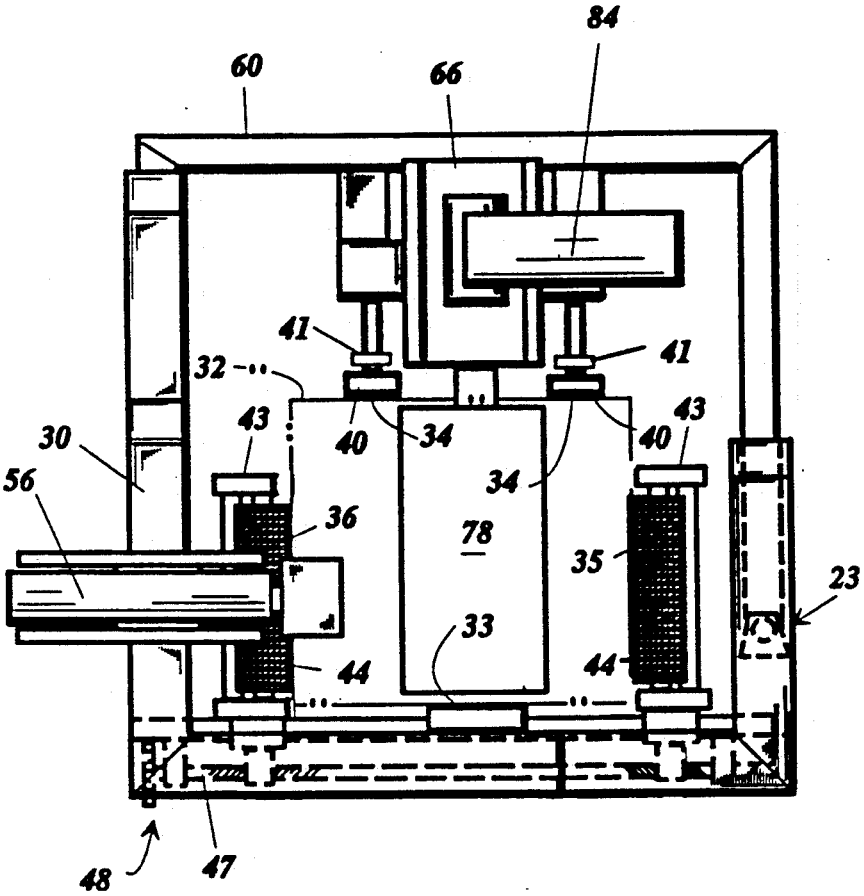
FIG. 5 is a top view of the preferred embodiment.

The dimensions of the interior chamber 32, shown in FIG. 5, are adjusted for each size package that is run through the assembly. The adjustment is made in such a way as to exert compression force in the way of an interference fit to all sides of the package while it ascends up the chamber 32.

Figure 6:
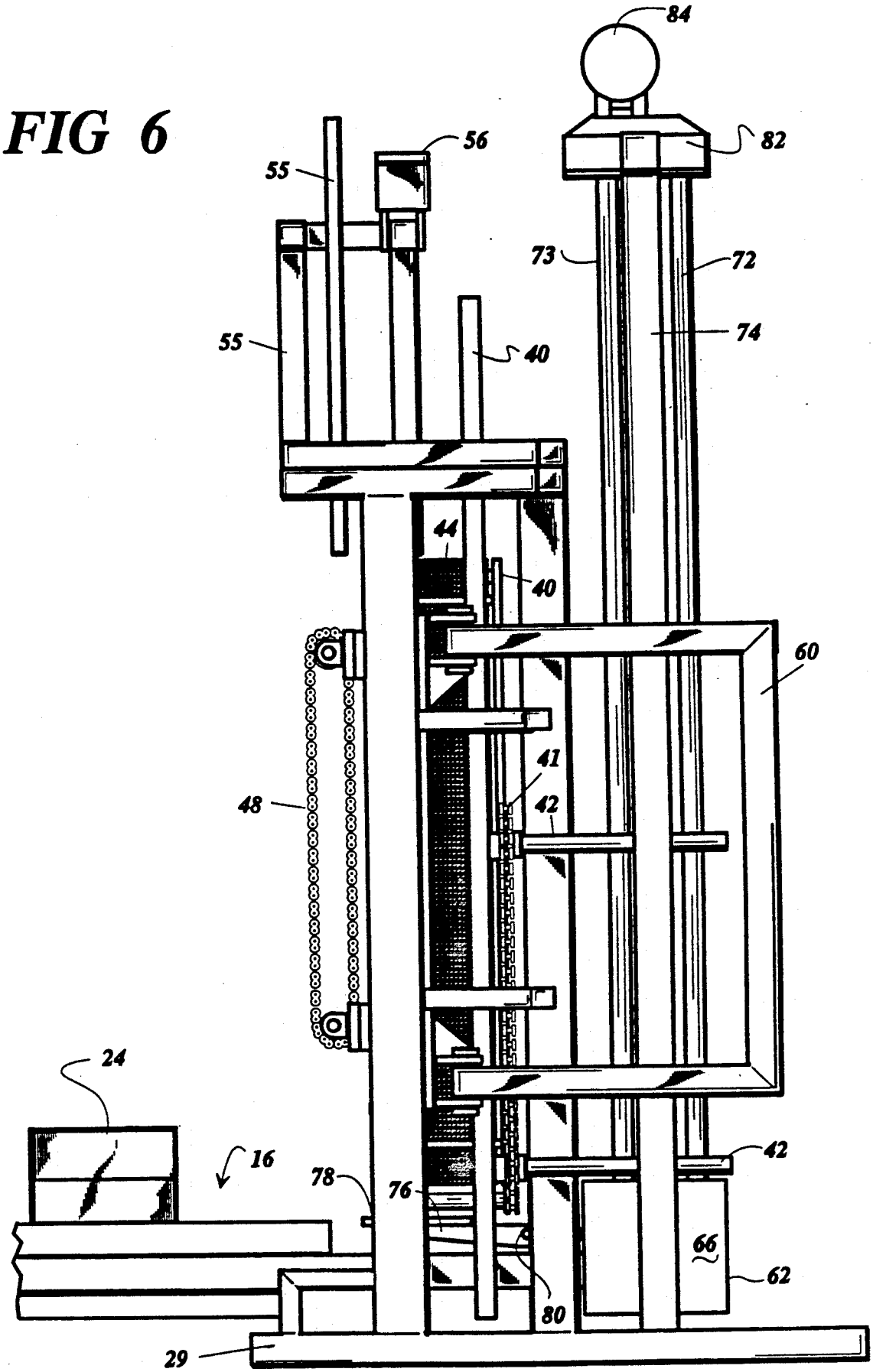
FIG. 6 is a side view of the preferred embodiment.
Figure 7:
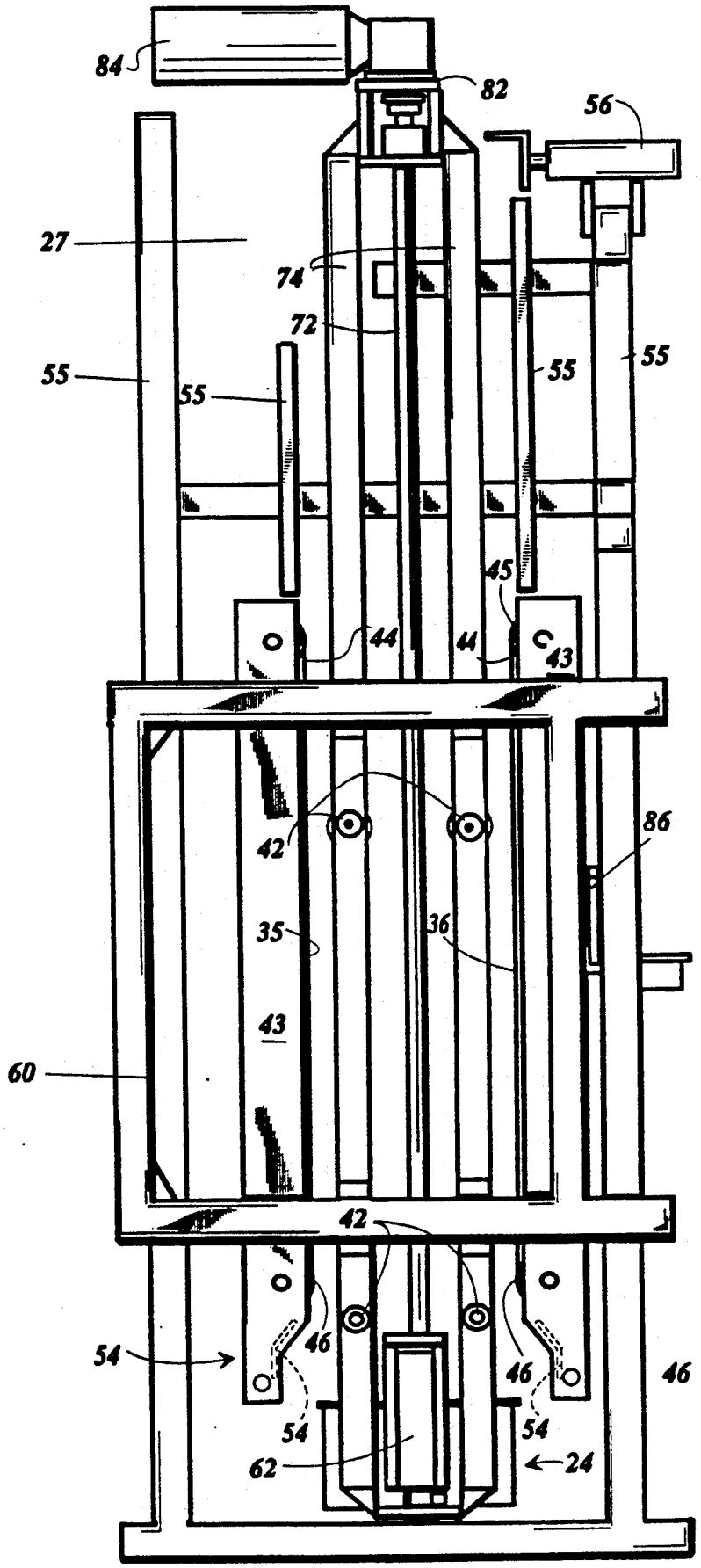
FIG. 7 is a rear view of the preferred embodiment.

Located at the top of the chamber 32 is a case ejector 56, shown in FIGS. 6 and 7, which pushes the case 24 off the compression chamber when it reaches the top. Sensors (not shown) are connected to the ejector 56 to control its operation. Additional framing 55 is provided at the upper end of the compression chamber 32 in order to laterally support the cases 24 as they ascend.

Figure 8:
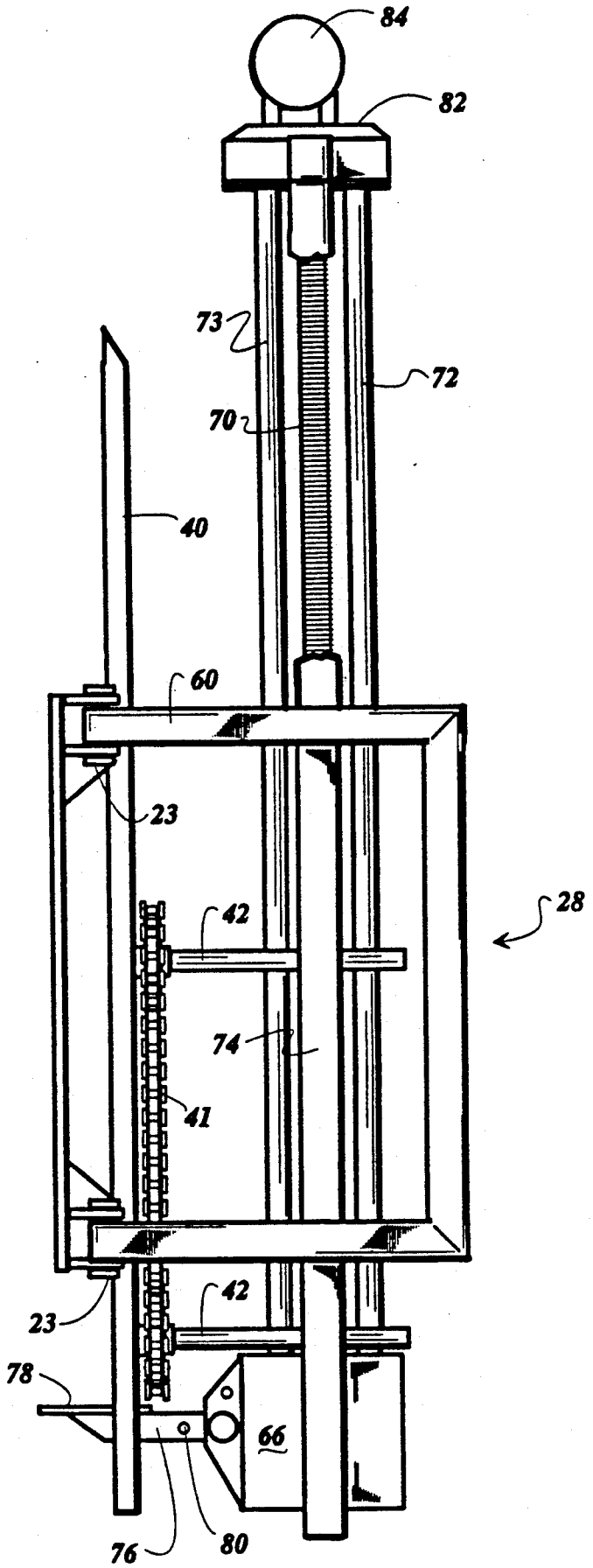
FIG. 8 is a detailed view of the purge unit of the preferred embodiment.

As stated earlier, the second part of the tower compression unit 10 is the purge unit 28 as shown in more detail in FIG. 8. The purge unit 28 includes a purge gate 60 which is hinged to the frame 30 of the tower compression unit 10 by means of hinges 23. The purge gate 60 is also integral with the second surface 34 of the compression chamber 32 having the adjustable rails 40. The purge unit 28 has an purge elevation assembly 62. The purge elevation assembly 62 is secured to the purge gate 60 and includes an elevator member 66 mechanically connected to a ball screw mechanism (not shown). A ball screw shaft 70 is positioned vertically on the purge gate 60 and rotates to provide the vertical movement for the elevator member 66. Guide rods 72, 73 are located on each side of the ball screw shaft 70 to support the elevator member 66 during operation. The guide rods 72, 73 help to ease the load exerted on the ball screw shaft 70 by the weight of the stack of cases 26 on the elevator member 66 during the purge operation. Vertical support beams 74 are also fixed to the purge gate 60 to provide structural support for the elevator member 66. The vertical beams 74, guide rods 72, 73 and ball screw shaft are structurally supported by a support plate 64 fixed to the gate 60.

A pivot arm 76, shown in FIG. 5, is secured to the elevator member 66. During normal operation of the compression tower 27, the arm 76 remains at the lower end of the gate 60 and in a vertical position. When the tower 27 is to be purged, the arm 76 is placed in a horizontal position and travels upward to the top of the compression tower. During the purging operation, a purge plate 78 is placed on to the pivot arm 76 and locked in place by means of a locking pin 80. The locking pin 80 is also used to secure the pivot arm 76 in place when it is in its vertical position.

FIG. 5 also shows a top view of the frame 30 of the tower compression unit 10. As illustrated in FIG. 5, the purge gate is L-shaped. The first section of the L-shaped purge gate 60 (located on the upper right hand side of FIG. 5) is connected to the hinges 23 which pivotably connect the purge gate 60 to the frame 30. The second section of the purge gate 60 (located at the top of FIG. 5) includes the second surface 34 of the compression chamber, made of the purge elevation assembly 62, and rails 40 and chain 41. The second surface 34 of the compression chamber consists of rails 40. In addition to the rails 40, the purge elevator assembly 62, rail adjustment screws 42 and chain 41 are also mounted to the second section of the gate 60.

At the top of the vertical support beams 74 is a motor platform 82 on which rests an electric motor and clutch brake assembly 84. The motor, when engaged, provides the output power needed to rotate the ball screw shaft 70. Additional sensors (not shown) are positioned at the top and bottom of the ball screw shaft 70 to control the travel of the elevator member 66.

When the compression tower 27 needs to be purged, normal compression operation is shut down and the purge gate 60 is opened by a latch mechanism 86 located between the compression tower frame 30 and the purge gate 60. Once the gate 60 is opened, the locking pin 80 is removed from the vertically oriented pivot arm 76 and the pivot arm is moved to a horizontal position. The purge plate 78 is placed on the pivot arm 76 and secured into position with the locking pin 80.

The gate 60 is then closed and as it closes, the plate 78 and arm 76 move directly under the stack of cases 26 within the compression chamber 32. As is shown in FIGS. 3 and 5, the arm 76 when fully extended from the gate 60 is able to clear the frame 30 as a result of the L-shaped gate desig. The clutch brake on the electric motor and clutch brake assembly 84 is released to enable the electric motor to turn the ball screw shaft 70. As the ball screw shaft 70 rotates, the elevator chamber 66 begins its upward travel. As each case 24 reaches the top of the compression chamber, the case ejector 56 pushes the case 24 off onto a conveyor (not shown) which takes them to a palletizer (not shown) where they are stacked and prepared for shipping. At the same time a signal is sent to the case ejector 56 to push a case 24 off onto a conveyor, a signal is sent to the brake to cease rotation of the ball screw shaft and causing the elevator member to stop ascending. When the ejector returns to its fully retracted position, a signal is sent to the brake to release and allow the elevator member 66 to continue ascending.

When the last case 24 is ejected, a position sensor (not shown) senses that the elevator member 66 has reached its highest position and sends a signal to the ball screw shaft 70 to reverse its rotation to enable the elevator member 66 to travel downward until it returns to its original position. Another sensor (not shown) is positioned at the bottom of the ball screw shaft 70 to sense when the elevator member 66 has reached its original position. When the elevator member 66 reaches its original position, the sensor signals the ball screw shaft 70 to cease rotation.

After the elevator member 66 has returned to its original position, the gate 60 is reopened and the purge plate 78 is removed by first removing the locking pin 80. The pivot arm 76 is moved to its vertical position and locked in place with the locking pin 80. The gate 60 is then closed and the purging operation is completed.

It will be appreciated that the embodiment discussed above is the preferred embodiment, falling within the scope of the appended claims, and that various alternative embodiments are contemplated. For example a means other than a ball screw arrangement may be used to elevate the cases to the top of the compression chamber 32. Moreover, the purge gate 60 may be located on a side of the compression chamber 32 other than the back. Additionally, the purge gate 60 may be attached to the tower compression unit 10 by alternative mechanical means other than hinges 23. It is also contemplated that the purging means not be associated with the purge gate.

I claim:

1. A tower compression unit comprising;

a case compression tower having a frame, a first vertical surface rigidly mounted to the frame, a second vertical surface perpendicular to the first surface, a third vertical surface perpendicular to the first surface, and second and third surfaces being adjustably mounted to the frame, the second and third surfaces being adjustable laterally simultaneously, a fourth vertical surface parallel to the first vertical surface, the vertical surfaces facing each other so as to define a vertical compression chamber;

an L-shaped gate having a first section arranged perpendicular and adjacent to a second section, the first section hinged to the frame, the second section facing into the chamber; and a means for removing a case within the compression chamber by vertically transferring it from a first level to a second elevated level, the removing means being mounted to the second section of the gate, and comprising an elevator and an outwardly protruding arm extended from the elevator and vertically movable within the compression chamber.

2. A device for removing cases from a tower compression unit comprising:

a vertically oriented compression tower comprising a frame, a first vertically oriented surface fixed to the frame, second and third parallel and spaced apart vertically oriented surfaces adjustably mounted to the frame and oriented perpendicular to the first surface, a fourth vertically oriented surface adjustably mounted to the frame and oriented parallel to and spaced apart from the first surface and perpendicular to the second and third surfaces, a means for simultaneously adjusting the lateral position of the second and third surfaces with respect to the frame, and a means for adjusting the fourth surface with respect to the frame;

an L-shaped gate having first and second gate sections, the first section being hinged to the frame;

an elevating means slidably mounted to the second section of the gate; and an arm connected to the elevating means;

whereby when the gate is opened, the arm can be placed in a horizontal position such that the arm faces the compression tower and clears the frame unobstructed as the gate is closed, the arm extends into the compression tower after the gate is closed for elevating cases within the compression tower to a top position for removal.

3. The device of claim 2 wherein the elevating means comprises a vertically oriented threaded shaft rotatably mounted to the second section of the gate;

a means for providing rotational motion to the shaft;

a member threadably engaged with the shaft; and a pair of parallel, vertically-oriented guide rods mounted on either side of the shaft on the second section of the gate, the guide rods in slidable communication with the member.

4. A method of removing a case within a case compression chamber, the chamber comprising a frame and four surfaces facing each other, the first surface fixed to the frame, the second and third surfaces adjustably mounted to the frame and oriented perpendicular to the first surface and parallel and spaced apart from one another, the fourth surface connected to the frame, comprising the following steps:

exposing one side of a case having four sides, a top and a bottom within the compression chamber, by opening an L-shaped gate, the gate comprising a first gate section hinged to the frame, and a second gate section perpendicular to the first gate section and integral with the fourth surface;

causing an arm pivotably connected to an elevator member to extend perpendicular to the gate, the elevator member threadably connected to a vertically oriented threaded rod, the rod being rotatably mounted to the second section of the gate, and the elevator member in sliding relation with a pair of vertically oriented guide rods, one guide rod being located on each side of the threaded rod;

closing the gate;

locating the arm below the bottom of the case; and causing the elevator to move upward in order to elevate the case.

* * * * *